United States Patent [19]

Cho

[11] Patent Number: 4,816,087

[45] Date of Patent: Mar. 28, 1989

[54] PROCESS FOR PRODUCING DUPLEX MODE RECRYSTALLIZED HIGH STRENGTH ALUMINUM-LITHIUM ALLOY PRODUCTS WITH HIGH FRACTURE TOUGHNESS AND METHOD OF MAKING THE SAME

[75] Inventor: Chul W. Cho, Monroeville, Pa.

[73] Assignee: Aluminum Company of America, Pittsburgh, Pa.

[21] Appl. No.: 36,735

[22] Filed: Apr. 10, 1987

Related U.S. Application Data

[63] Continuation-in-part of Ser. No. 927,054, Nov. 4, 1986, which is a continuation-in-part of Ser. No. 793,260, Oct. 31, 1985.

[51] Int. Cl.[4] ..... C22F 1/04

[52] U.S. Cl. ..... 148/2; 148/11.5 A; 148/12.7 A; 148/415; 148/416; 148/417; 148/418; 148/437; 148/438; 148/439; 148/440

[58] Field of Search ..... 148/2, 11.5 A, 12.7 A, 148/415–418, 437–440

[56] References Cited

U.S. PATENT DOCUMENTS

| | | | |
|---|---|---|---|
| 1,620,081 | 3/1927 | Czochralski et al. | 420/528 |
| 1,620,082 | 3/1927 | Czochralski | 420/531 |
| 2,381,219 | 8/1945 | LeBaron | 75/139 |
| 2,915,390 | 12/1959 | Criner | 75/141 |
| 2,915,391 | 12/1959 | Criner | 75/142 |
| 4,094,705 | 6/1978 | Sperry et al. | 148/2 |
| 4,409,038 | 10/1983 | Weber | 148/12.7 A |

FOREIGN PATENT DOCUMENTS

| | | |
|---|---|---|
| 90583 | 5/1983 | European Pat. Off. . |
| 1927500 | 2/1971 | Fed. Rep. of Germany . |
| 1148719 | 6/1957 | France . |
| 3401391 | 4/1984 | PCT Int'l Appl. . |
| 8502416 | 6/1985 | PCT Int'l Appl. . |
| 707373 | 10/1974 | U.S.S.R. . |
| 1172735 | 12/1969 | United Kingdom . |
| 2115836 | 9/1983 | United Kingdom . |

OTHER PUBLICATIONS

"Advanced Aluminum Metallic Materials and Processes for Application to Naval Aircraft Structures" by W. T. Highberger et al., 12th National SAMPE Technical Conference, Oct. 7–9, 1980.

"Alloying Additions and Property Modification in Al-Li—X Systems" by F. W. Gayle, Int'l. Al-Li Conference, Stone Mountain, Ga., May 19–21, 1980.

"Heat Treatment, Microstructure and Mechanical Property Correlations in Al-Li-Cu and Al-Li-Mg P/M Alloys" by G. Chanani et al., Society/AIME, Dallas, Tex., Feb. 17–18, 1982.

(List continued on next page.)

*Primary Examiner*—R. Dean

*Attorney, Agent, or Firm*—Andrew Alexander

[57] ABSTRACT

A method of producing a recrystallized aluminum-lithium product having improved levels of strength and fracture toughness is disclosed. The method comprises the steps of: providing a lithium-containing aluminum base alloy comprised of 0.5 to 4.0 wt. % Li, 0 to 5.0 wt. % Cu, 0 to 5.0 wt. % Mg, 0.10 to 1.0 wt. % of a grain structure control element selected from the class consisting of Zr, Cr, Hf, Ti, V, Sc, and Mn, 0.5 wt. % max. Fe, and 5 wt. % max. Si, with the balance consisting essentially of aluminum and incidental elements and impurities; heating the body to a high presoak temperature to homogenize the alloy; cooling the alloy to a first hot working temperature; reheating the alloy, after hot working, back to a high annealing temperature; cooling the alloy to a second hot working temperature to produce a first product; reheating the alloy to a lower annealing temperature; and then cold working the alloy. The cold worked product is solution heat treated, quenched and aged to provide a substantially dual mode recrystallized sheet product having improved levels of strength and fracture toughness and further characterized by a fine grain structure adjacent the surface of the alloy product and a coarse grain structure in the interior thereof.

43 Claims, 6 Drawing Sheets

OTHER PUBLICATIONS

"Age Hardening Behavior of Al-Li-(Cu)-(Mg)-Zr P/M Alloys" by D. J. Chellman et al., Proceedings of 1982 Nat'l. P/M Conf.—P/M Products and Properties Session, Montreal, Canada, May 1982.

"Precipitation in Al-Li-Cu Alloys" by J. E. O'Neal et al., 39th Annual EMSA Meeting, Atlanta, Ga., Aug. 10-14, 1981.

"HVEM In Situ Deformation of Al-Li-X Alloys" by R. E. Crooks et al., Scripta Metallurgica, vol. 17, pp. 643-647, 1983.

"Developments in Structures and Manufacturing Techniques" by C. J. Peel et al., Aeronautical Journal, Sept. 1981.

"Aluminum-Lithium Alloys: New Materials for Tomorrow's Technology" by T. H. Sanders, Jr. et al., Foote Prints, vol. 44, No. 1, 1981.

"The Mechanical Properties of Aluminum-Lithium Alloy" by M. Y. Drtis et al., Splavy Tsvetnykh Metalloy, 1972, pp. 187-192.

"Factors Influencing Fracture Toughness and Other Properties of Aluminum-Lithium Alloys" by T. H. Sanders et al., Naval Air Dev. Center Contract No. N62269-76-C-0271 for Naval Air Systems Command. Lockheed Report No. LM C-D766966, Sept. 1980, p. 10.

"Effect of Composition and Heat Treatment on Strength and Fracture Characteristics of Al-Li-Mg Alloys" by S. J. Harris, B. Noble and K. Dinsdale, Pub. 1984 Feb. according to information from AIME.

2091 T3 sheet
0.100" gauge
S.No. 575419-83AA
DUPLEX structure
Full Thickness
Magnification; 50X

EFFECT OF STRETCH ON LONG-TRANSVERSE TOUGHNESS

TEAR STRENGTH - YIELD STRENGTH RATIO VS YIELD STRENGTH FOR 2024

PROCESS FOR PRODUCING DUPLEX MODE RECRYSTALLIZED HIGH STRENGTH ALUMINUM-LITHIUM ALLOY PRODUCTS WITH HIGH FRACTURE TOUGHNESS AND METHOD OF MAKING THE SAME

CROSS REFERENCE TO RELATED APPLICATIONS

This application is a continuation-in-part of U.S. Ser. No. 927,054, filed Nov. 4, 1986, which is a continuation-in-part of U.S. Ser. No. 793,260, filed Oct. 31, 1985.

BACKGROUND OF THE INVENTION

This invention relates to aluminum base alloy products, and more particularly, it relates to improved lithium containing aluminum base alloy products and a method of producing the same.

In the aircraft industry, it has been generally recognized that one of the most effective ways to reduce the weight of an aircraft is to reduce the density of aluminum alloys used in the aircraft construction. For purposes of reducing the alloy density, lithium additions have been made. However, the addition of lithium to aluminum alloys is not without problems. For example, the addition of lithium to aluminum alloys often results in a decrease in ductility and fracture toughness. Where the use is in aircraft parts, it is imperative that the lithium containing alloy have both improved fracture toughness and strength properties.

With respect to conventional alloys, both high strength and high fracture toughness appear to be quite difficult to obtain when viewed in light of conventional alloys, such as AA (Aluminum Association) 2024-T3X and 7050-TX normally used in aircraft applications. For example, a paper to J. T. Staley entitled "Microstructure and Toughness of High-Strength Aluminum Alloys", Properties Related to Fracture Toughness, ASTM STP605, American Society for Testing and Materials, 1976, pp. 71–103, shows generally that for AA2024 sheet, toughness decreases as strength increases. Also, in the same paper, it will be observed that the same is true of AA7050 plate. More desirable alloys would permit increased strength with only minimal or no decrease in toughness or would permit processing steps wherein the toughness was controlled as the strength was increased in order to provide a more desirable combination of strength and toughness. Additionally, in more desirable alloys, the combination of strength and toughness would be attainable in an aluminum-lithium alloy having density reductions in the order of 5 to 15%. Such alloys would find widespread use in the aerospace industry where low weight and high strength and toughness translate to high fuel savings. Thus, it will be appreciated that obtaining qualities, such as high strength, at little or no sacrifice in toughness, or where toughness can be controlled as the strength is increased would result in a remarkably unique aluminum-lithium alloy product.

The present invention solves problems which limited the use of these alloys and provides and improved lithium containing aluminum base alloy product which can be processed to provide improved strength characteristics while retaining high toughness properties.

SUMMARY OF THE INVENTION

An object of this invention is to provide a recrystallized thin gauge plate, or recrystallized sheet gauge, aluminum-lithium alloy, including cladded sheet and thermo-mechanical processing practice, which greatly improves strength and fracture toughness properties of such alloy.

A principal object of this invention is to provide an improved lithium-containing aluminum base alloy product.

Another object of this invention is to provide an improved aluminum-lithium alloy product having improved strength and toughness characteristics.

Yet another object of this invention is to provide an aluminum-lithium alloy product capable of being worked after solution heat treating to improve strength properties without substantially impairing its fracture toughness.

A further object of the invention is to provide an improved aluminum-lithium alloy having improved strength and fracture toughness properties formed by thermomechanical processing of the alloy to produce a recrystallized product having a duplex mode of crystallization.

A still further object of the invention is to provide a method of forming such a duplex mode aluminum-lithium alloy having improved strength and fracture toughness.

These and other objects will become apparent from the specification, drawings, and claims appended hereto.

In accordance with these objects, a duplex mode recrystallized aluminum-lithium alloy product having improved levels of strength and fracture toughness is disclosed. The method of forming this aluminum-lithium alloy product comprises the steps of: providing a lithium-containing aluminum base alloy comprised of 0.5 to 4.0 wt. % Li, 0 to 5.0 wt. % Cu, 0 to 5.0 wt. % Mg, 0.10 to 1.0 wt. % of a grain structure control element selected from the class consisting of Zr, Cr, Hf, Ti, V, Sc, and Mn, 0.5 wt. % max. Fe, and 5 wt. % max. Si, with the balance consisting essentially of aluminum and incidental elements and impurities: heating the body to a high presoak temperature to homogenize the alloy; cooling the alloy to a first hot working temperature: reheating the alloy, after hot working, back to a high annealing temperature; cooling the alloy to a second hot working temperature to produce a first product; reheating the alloy to a lower annealing temperature; and then cold working the alloy. The cold worked product is solution heat treated, quenched and aged to provide a substantially dual mode recrystallized sheet product having improved levels of strength and fracture toughness.

DETAILED DESCRIPTION OF THE PREFERRED EMBODIMENTS

Figure 1:
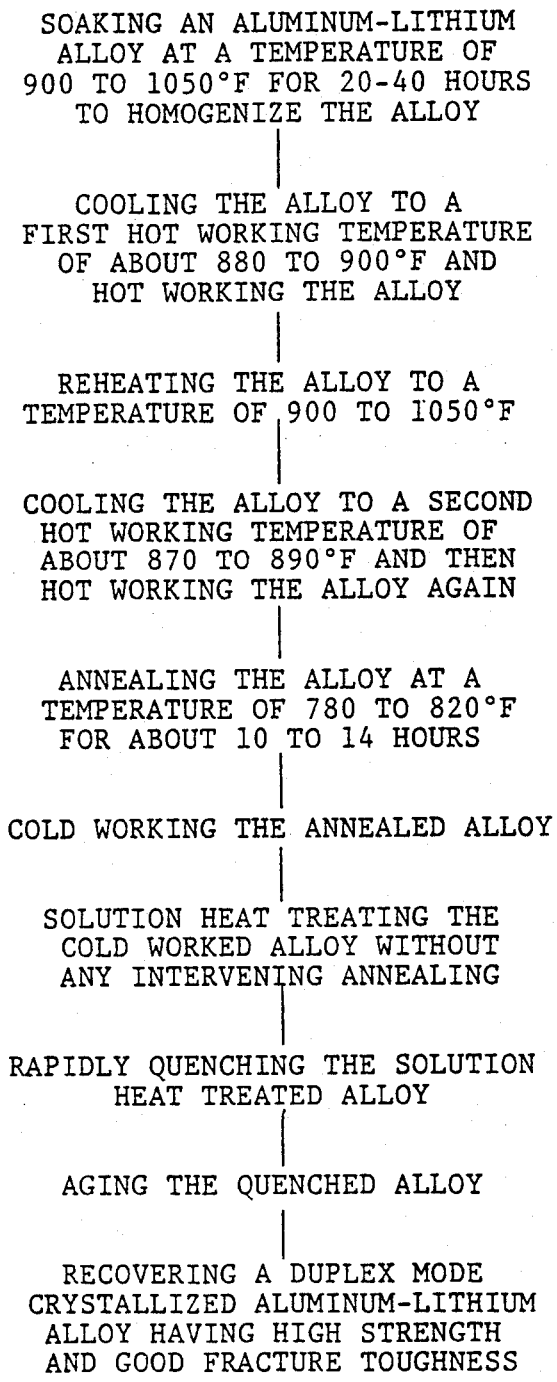
FIG. 1 is a flowsheet illustrating the process of the invention.

The alloy of the present invention can contain 0.5 to 4.0 wt. % Li, 0 to 5.0 wt. % Mg, up to 5.0 wt. % Cu, 0 to 1.0 wt. % of a grain structure control element selected from the class consisting of Zr, Cr, Hf, Ti, V, Sc, and Mn, 0.5 wt. % max. Fe, and 0.5 wt. % max. Si, with the balance consisting essentially of aluminum and in:idental impurities. Zn may be added in the range of 0 to 7.0 wt. % and Mn may be added in the range of 0 to 2.0 wt. % as additional alloying elements. The impurities are preferably limited to about 0.05 wt. each, and the combination of impurities preferably should not exceed 0.15 wt. %. Within these limits, it is preferred that the sum total of all impurities not exceed 0.35 wt. %.

A preferred alloy in accordance with the present invention can contain 1.0 to 4.0 wt. % Li, 0.1 to 5.0 wt. % Cu, 0 to 5.0 wt. % Mg, 0.10 to 0.15 wt. % Zr, 0 to 2 wt. % Mn, the balance aluminum and impurities as specified above. A typical alloy composition would contain 2.0 to 3.0 wt. % Li, 0.5 to 4.0 wt. Cu, 0 to 3.0 wt. % Mg. 0.10 to 0.15 wt. % Zr, 0 to 1.0 wt. % Mn and max. 0.1 wt. % of each of Fe and Si, with the balance consisting essentially of :aluminum and impurities.

As will be appreciated from the foregoing alloy compositions, the present invention includes Al-Li-Cu-Mg alloys, such as AA2091 type Al-Li alloys. Such alloy composition can have 1.5 to 2.5 wt. % Li, 1.6 to 2.8 wt. % Cu, 0.7 to 2.5 wt. % Mg, and 0.10 to 0.15 wt. % Zr, with a preferred composition being 1.7 to 2.3 wt. % Li, 1.8 to 2.5 wt. % Cu, 1.1 to 1.9 wt. % Mg and 0.10 to 0.15 wt. % Zr, with the balance consisting essentially of aluminum and impurities.

In the present invention, lithium is very important not only because it permits a significant decrease in density but also because it improves tensile and yield strengths markedly as well as improving elastic modulus. Additionally, the presence of lithium improves fatigue resistance. Most significantly though, the presence of lithium in combination with other controlled amounts of alloying elements permits aluminum alloy products which can be worked to provide unique combinations of strength and fracture toughness while maintaining meaningful reductions in density. It will be appreciated that less than 0.5 wt. % Li does not provide for significant reductions in the density of the alloy and 4 wt. % Li is close to the solubility limit of lithium, depending to a significant extent on the other alloying elements. It is not presently expected that higher levels of lithium would improve the combination of toughness and strength of the alloy product.

With respect to copper, particularly in the ranges set forth hereinabove for use in accordance with the present invention, its presence enhances the properties of the alloy product by reducing the loss in fracture toughness at higher strength levels. That is, as compared to lithium, for example, in the present invention copper has the capability of providing higher combinations of toughness and strength. For example, if more additions of lithium were used to increase strength without copper, the decrease in toughness would be greater than if copper additions were used to increase strength. Thus, in the present invention when selecting an alloy, it is important in making the selection to balance both the toughness and strength desired, since both elements work together to provide toughness and strength uniquely in accordance with the present invention. It is important that the ranges referred to hereinabove, be adhered to, particularly with respect to the upper limits of copper, since excessive amounts can lead to the undesirable formation of intermetallics which can interfere with fracture toughness.

Magnesium is added or provided in this class of aluminum alloys mainly for purposes of increasing strength although it does decrease density slightly and is advantageous from that standpoint. It is important to adhere to the upper limits set forth for magnesium because excess magnesium can also lead to interference with fracture toughness, particularly through the formation of undesirable phases at grain boundaries.

Zirconium is the preferred material added for grain structure control. Cr, Hf, Ti, V, Sc, and Mn can also be used for grain structure control, either instead of, or in addition to, zirconium, but on a less preferred basis.

Toughness or fracture toughness as used herein refers to the resistance of a body, e.g., sheet or plate, to the unstable growth of cracks or other flaws.

Figure 2:
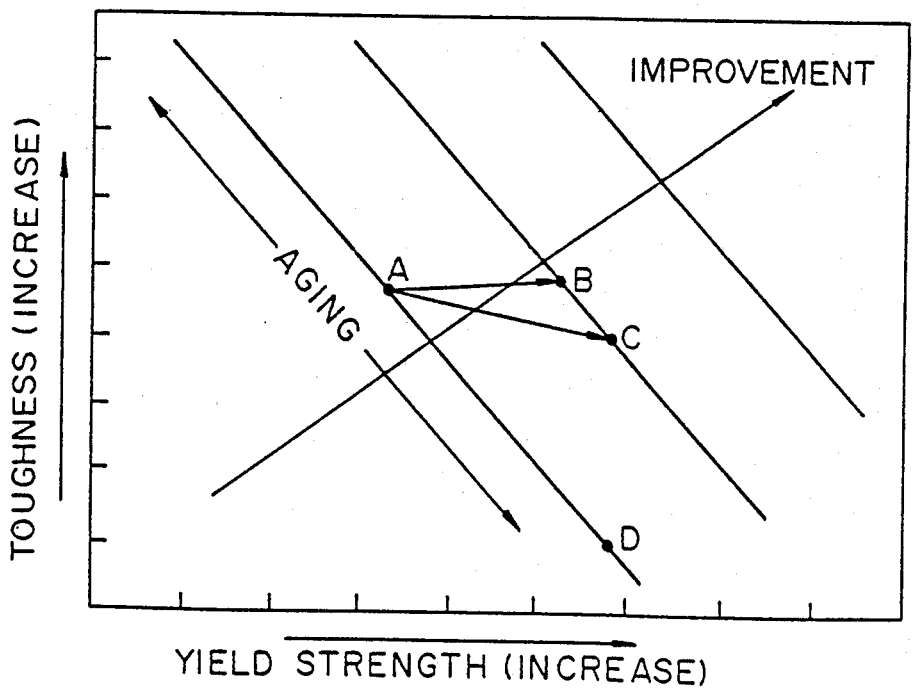
FIG. 2 is a graph illustrating different toughness yield strength relationships where shifts in the upward direction and to the right represent improved combinations of these properties.

Improved combinations of strength and toughness is a shift in the normal inverse relationship between strength and toughness towards higher toughness values at given levels of strength or towards higher strength values at given levels of toughness. For example, in FIG. 2, going from point A to point D represents the loss in toughness usually associated with increasing the strength of an alloy. In contrast, going from point A to point B results in an increase in strength at the same toughness level. Thus, point B is an improved combination of strength and toughness. Also, in going from point A to point C results in an increase in strength while toughness is decreased, but the combination of strength and toughness is considered to be improved. Also, taking point B relative to point D, toughness is improved and strength has decreased yet the combination of strength and toughness are again considered to be improved.

As well as providing the alloy product with controlled amounts of alloying elements as described hereinabove, in accordance with the invention, the alloy product is prepared according to specific method steps in order to provide the most desirable characteristics of both strength and fracture toughness. Thus, the alloy, as described herein, can be provided as an ingot or billet for fabrication into a suitable wrought product by casting techniques currently employed in the art for cast products, with continuous casting being preferred. It should be noted that the alloy may also be provided in billet form consolidated from fine particulate, such as powdered aluminum alloy, having the compositions in the ranges set forth hereinabove. The powder or particulate material can be produced by processes, such as atomization, mechanical alloying, and melt spinning. The ingot or billet may be preliminarily worked or shaped to provide suitable stock for subsequent working operations.

The alloy product formed using the described alloying constituents and processed in accordance with the thermomechanical steps which will be described in more detail below, comprises a recrystallized structure which is herein termed a "duplex mode" structure due to the presence of fine grain structure adjacent the exterior of the thermomechanically processed alloy and a coarse grain structure in the interior at the center of the alloy product, i.e., at the point T/2 where T is the thickness of the alloy product with a gradation of grain size therebetween. By the term "fine grain structure" is meant a grain structure having grains whose average diameter is about 3 to 75 microns, while by the term "coarse grain structure" is meant a grain structure having grains whose average diameter is greater than the fine grain structure, e.g., 100 to 2000 microns.

Prior to the subsequent thermomechanical steps, the alloy stock is preferably subjected to homogenization, preferably at metal temperatures in the range of 900° to 1050° F., most preferably about 980° F. for a period of time of at least one hour to dissolve soluble elements, such as Li and Cu, and to homogenize the internal structure of the metal. A preferred time period is about 24 hours or more in the homogenization temperature range. Normally, the heat up and homogenizing treatment does not have to extend for more than 40 hours; however, longer times are not normally detrimental. A time of 20 to 40 hours at the homogenization temperature has been found quite suitable. In addition to dissolving constituent to promote workability, this homogenization treatment is important in that it is believed to precipitate the Mn and Zr-bearing dispersoids which help to control final grain structure.

After the homogenizing treatment, the metal, if cooled, is reheated back to the homogenization temperature, i.e., about 900° to 1050° F., preferably about 980° F. and then allowed to air cool down to a temperature of about 850° to 900° F., preferably about 890° F., and then hot worked at this temperature such as by rolling or extrusion or otherwise subjected to working operations to produce stock, such as sheet, plate, or extrusions, or other stock suitable for shaping into the end product.

This hot working step preferably may comprise hot rolling which can be used to reduce the thickness of the ingot to about 1 to 5 inches, i.e., to a slab gauge to form an intermediate product.

In accordance with the invention, the alloy material, after the initial hot working step, is reheated again to the homogenization temperature, i.e., about 900° to 1050° F., preferably about 980° F. and then allowed to air cool down to a slightly lower temperature of about 850° to 900° F., preferably about 880° F., and then hot worked again at this slightly lower temperature. Preferably, this second hot working step will ag.ain comprise a hot rolling step which will further reduce the gauge of the metal down to about twice the final desired gauge, i.e., down to about 0.250 to 0.100 inch.

The alloy product is now annealed for from about 4 to 16 hours, preferably about 12 hours, at a temperature in the range of 750° to 860° F., preferably 780° to 820° F., typically about 800° F. and then air cooled to room temperature.

To produce a recrystallized, duplex grained structure sheet product in accordance with the invention, the alloy product is cold worked. Preferably, this cold working step comprises cold rolling the alloy product to the final desired product gauge, comprising about a 25% to 80% thickness reduction.

The cold worked alloy product is then solution heat treated typically at a temperature in the range of 960° to 1020° F., preferably about 975° to 995° F. for a period in the range of from about 20 to 60 minutes, preferably about 30 minutes. For the solution heat treating step, preferably, the heat-up rate is controlled so as to ensure a heat-up rate of greater than 0.2° F. sec., and typically greater than 0.4° F. sec., e.g., about 0.5° F. sec. Typically, heat-up rates are in the range of 0.5° to 50° F. sec. with higher heat-up rates not presently known to be detrimental.

It should be understood that this material may be provided with a cladding for purposes of enhancing appearance and corrosion resistance. Typically, cladding alloys included the AA1100 and AA1200 type alloys and AA7072 alloy.

To further provide for the desired strength and fracture toughness necessary to the final product and to the operations in forming that product, the product should be rapidly quenched to permit forming the desired duplex mode of crystallization within the alloy product. Thus, it is preferred, in the practice of the present invention, that the quenching rate be at least 100° F. per second from solution temperature to a temperature of about 200° F. or lower. A preferred quenching rate is at least 200° F. per second in the temperature range of 900° F. or more to 200° F. or less using a water quench.

Figure 5:
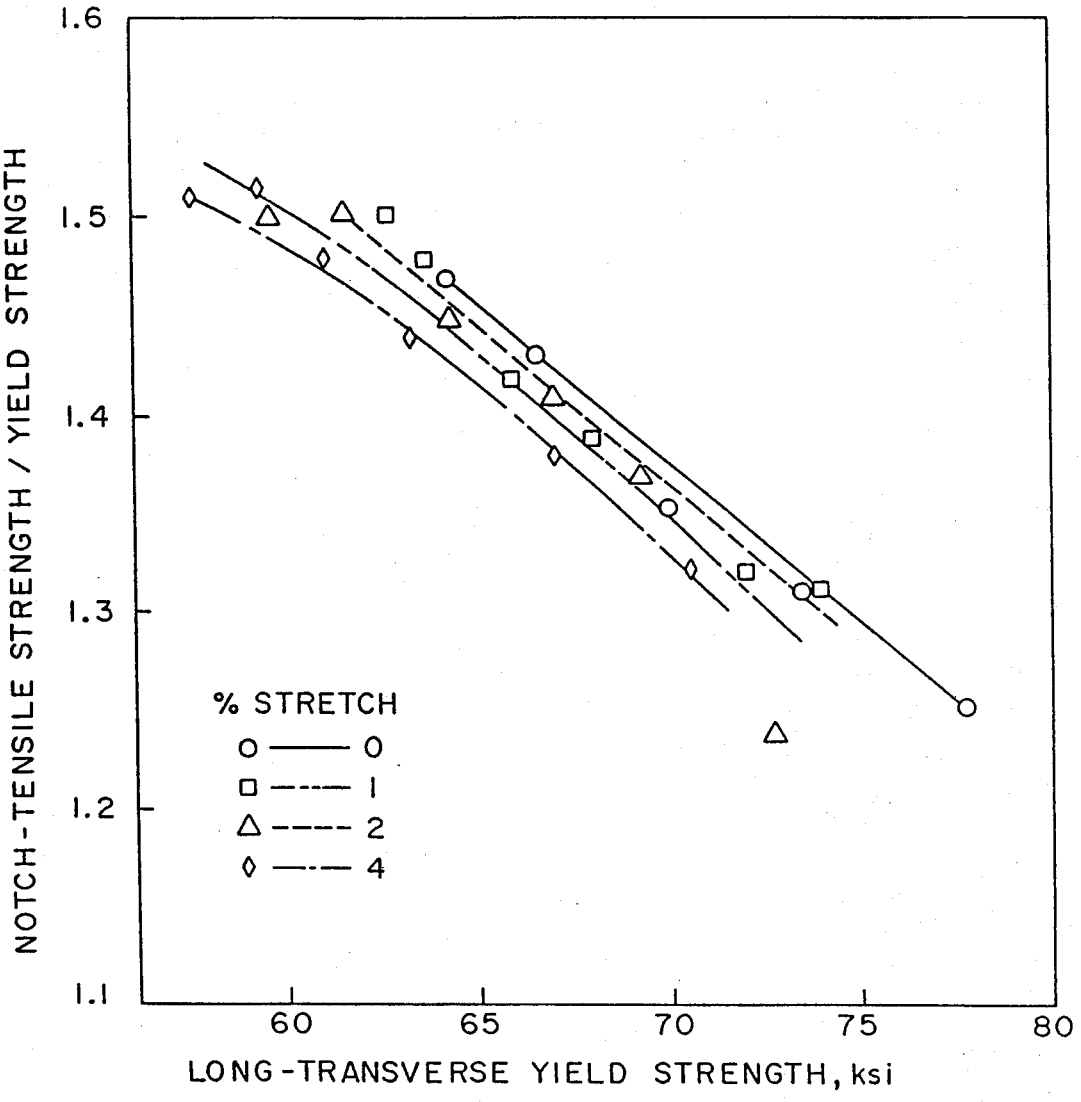
FIG. 5 shows that the relationship between toughness (notch-tensile strength divided by yield strength) and yield strength decreases with increased amounts of stretching for AA7050.
Figure 6:
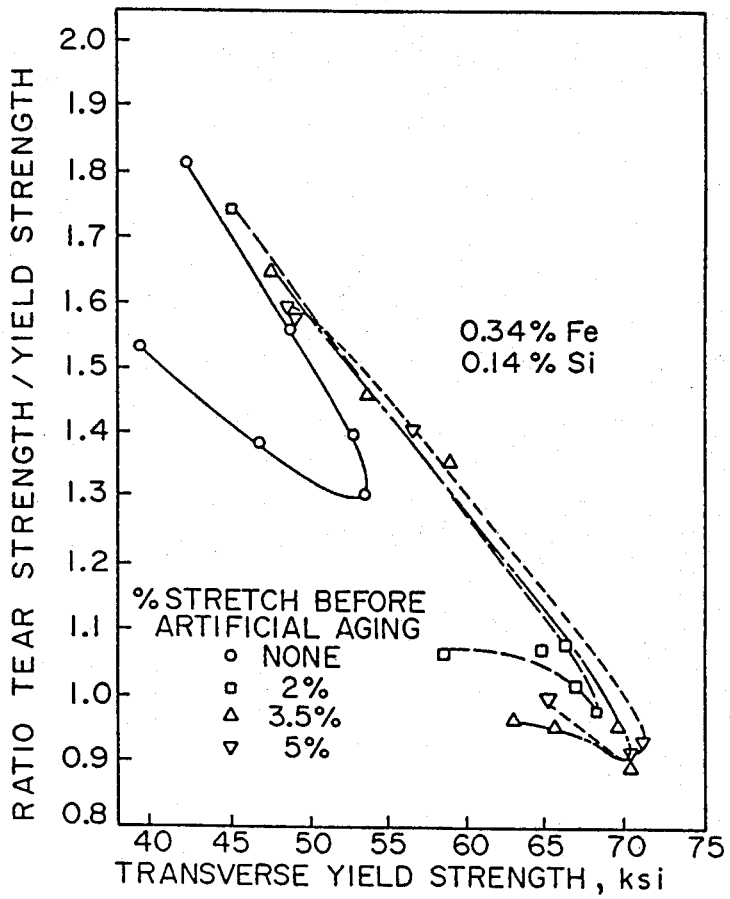
FIG. 6 shows that stretching AA2024 beyond 2% does not significantly increase the toughness-strength relationship for this alloy.

After solution heat treatment and quenching, as hereinabove described, the improved sheet, plate, or extrusion and other wrought products can have a range of yield strength from about 25 to 50 ksi and a level of sheet fracture toughness (plane stress fracture toughness) in the range of about 50 to 300 (ksi-sqrt [inch]). However, with the use of artificial aging to improve strength, fracture toughness can drop considerably. To minimize the loss in fracture toughness associated in the past with improvement in strength, it has been discovered that the solution heat treated and quenched alloy product, particularly sheet, plate, or extrusion, may be stretched, preferably at room temperature, an amount greater than 3% of its original length or otherwise worked or deformed to impart to the product a working effect equivalent to stretching greater than 3% of its original length. The working effect referred to is meant to include rolling and forging as well as other working operations. It has been discovered that the strength of sheet or plate, for example, of the subject alloy can be increased substantially by stretching prior to artificial aging, and such stretching causes little or no decrease in fracture toughness. It will be appreciated that in comparable high strength alloys, stretching can produce a significant drop in fracture toughness. Stretching AA7050 reduces both toughness and strength, as shown in FIG. 5, taken from the reference by J. T. Staley, mentioned previously. Similar toughness-strength data for AA2024 are shown in FIG. 6. For AA2024, stretching 2% increases the combination of toughness and strength over that obtained without stretching; however, further stretching does not provide any substantial increases in toughness. Therefore, when considering the toughness-strength relationship, it is of little benefit to stretch AA2024 more than 2%, and it is. detrimental to stretch AA7050. In contrast, when stretching or its equivalent is combined with artificial aging, an alloy product in accordance with the present invention can be obtained having significantly increased combinations of fracture toughness and strength.

In the case of alloy sheet or plate in accordance with the invention, stretching or equivalent working is greater and can be in the range of 1 to 10%. Further, it is preferred that stretching be in the range of about a 2 to 8% increase over the original length with typical increases being in the range of 4 to 6%.

After the alloy product of the present invention has been worked, it may be artificially aged to provide the combination of fracture toughness and strength which are so highly desired in aircraft members. This can be accomplished by subjecting the sheet or plate or shaped product to a temperature in the range of 150° to 400° F. for a sufficient period of time to further increase the yield strength. Some compositions of the alloy product are capable of being artificially aged to a yield strength as high as 85 ksi. However, the useful strengths are in the range of 40 to 80 ksi and corresponding sheet fracture toughnesses (plain stress fracture toughness) can be higher than 240 ksi-sqrt(inch) and typically in the range of 60 to 240 ksi-sqrt(inch). Flat rolled products in accordance with the invention may be used in the naturally aged condition (T3 or W temper) or may be artifically aged depending on the strength requirements. Preferably, artificial aging is accomplished by subjecting the alloy product to a temperature in the range of 275° to 375° F. for a period of at least 30 minutes. A suitable artificial aging practice contemplates a treatment of about 8 to 24 hours at a temperature of about 325° F. Further, it will be noted that the alloy product formed in accordance with the present invention may be subjected to any of the typical underaging treatments well known in the art. Also, while reference has been made herein to single aging steps, multiple aging steps, such as two or three agingssteps, are contemplated and stretching or its equivalent working may be used prior to or even after part of such multiple aging steps.

To further illustrate the invention, an aluminum alloy consisting essentially of 2.11 wt. % Li, 2.09 wt. % Cu, 0.153 wt. % Mg, and 0.11 wt. % Zr, with the balance consisting essentially of aluminum with less than 0.2 wt. % impurities was cast into an ingot suitable for rolling. The ingot was heated to 980° F. and then maintained at this temperature for 24 hours to homogenize the alloy. The ingot was then allowed to air cool to 890° F. at which temperature it was hot rolled down to a slab gauge of 2.5 inches. The hot rolled ingot was then reheated to 980° F. and held at this temperature for 2 hours after which it was again allowed to air cool to a temperature of 880° F. at which temperature it was again hot rolled down to a thickness of 0.200 inch. The product was then annealed at a temperature of 800° F. for a period of 12 hours and then air cooled to room temperature. The cooled product was then cold rolled to a final gauge of 0.100 inch. The cold rolled sheet product was then solution heat treated, without any intervening anneal, by heating the sheet to 990° F. and holding it at this temperature for 30 minutes followed by a cold water quench.

Figure 3:
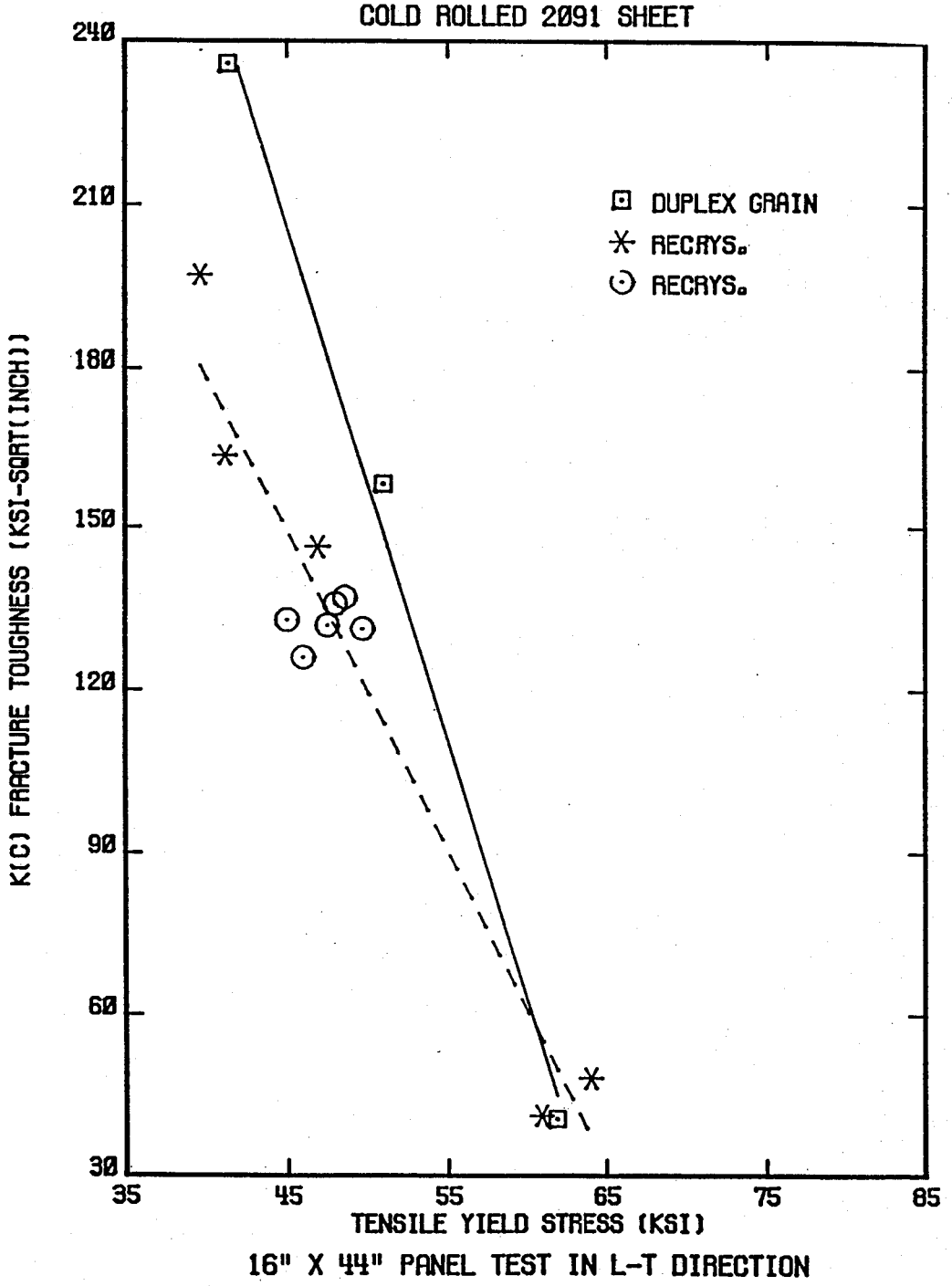
FIG. 3 is a graph showing the tensile yield stress plotted against fracture toughness for the duplex mode alloy product of the invention compared to other unrecrystallized and recrystallized AA2091 alloy products.
Figure 4:
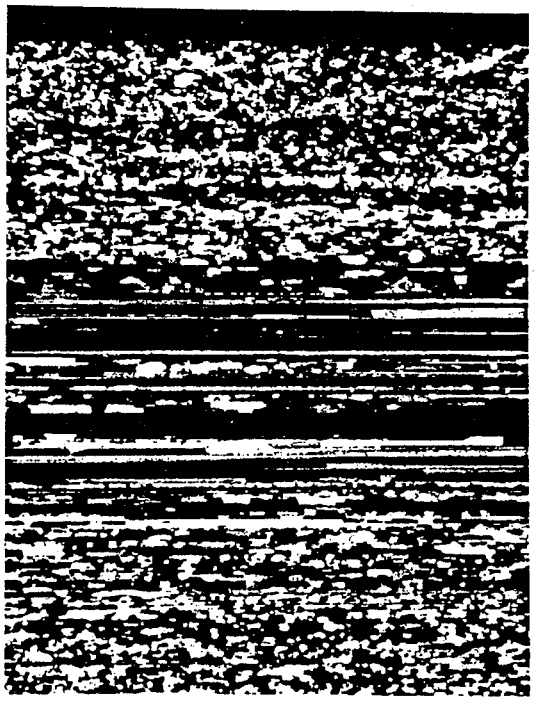
FIG. 4 shows the duplex mode crystal structure of the alloy product of the invention.

The resultant product was microstructurally examined by optical metallography and found to have a fine grain structure adjacent the surface and a coarse grain structure formed in the interior of the sheet as seen in FIG. 4. As shown in the graph of FIG. 3, it will be seen that the duplex grain structure product formed in accordance with the invention is capable of providing higher fracture toughness at corresponding tensile field strengths than conventionally recrystallized structure formed from the same Al-Li alloy.

Thus the invention provides a superior alloy product containing a duplex, recrystallized grain structure as shown in FIG. 4 and method of making same which results in an alloy product having higher fracture toughness at corresponding tensile yield strengths than conventionally recrystallized structures.

Having thus described the invention, what is claimed is:

1. A duplex recrystallized grain structured aluminum-lithium product having improved levels of strength and fracture touhness characterized by a fine grain structure at the surface of the product and a coarse grain structure at the center of the product comprised of a lithium-containing aluminum base alloy consisting essentially of 0.5 to 4.0 wt. % Li, 0 to 5.0 wt. % Cu, 0 to 5.0 wt. % Mg, 0.10 to 1.0 wt. % of a grain structure control element selected from the class consisting of Zr, Cr, Hf, Ti, V, Sc, and Mn, 0.5 wt. % max. Fe, and 5 wt. % max. Si, with the balance consisting essentially of aluminum and incidental elements and impurities.

2. The alloy product of claim 1 wherein said aluminumlithium alloy consists essentially of from 1.5 to 2.5 wt. % Li, 1.6 to 2.8 wt. % Cu, 0.7 to 2.5 wt. % Mg, and 0.03 to 0.19 wt. % Zr, with the balance consisting essentially of aluminum and impurities.

3. The alloy product of claim 1 wherein said aluminum-lithium alloy consists essentially of from 1.7 to 2.3 wt. % Li, 1.8 to 2.5 wt. % Cu, 1.1 to 1.9 wt. % Mg, and 0.10 to 0.15 wt. % Zr, with the balance consisting essentially of aluminum and impurities.

4. The alloy product of claim 1 wherein said alloy product has been thermomechanically processed by heating to a presoak temperature of from about 900° to 1050° F. and held at this temperature for about 20 to 40 hours to homogenize the alloy followed by two hot working steps carried out in a temperature range of about 850° to 900° F. with an intermediate heating back to said presoak temperature and an anneal followed by cold working after said hot working steps.

5. The alloy product of claim 4 wherein the alloy, atter cold working, has been solution heat treated, quenched, and aged, without an intervening anneal after said cold working, to provide recrystallized sheet product having improved levels of strength and fracture toughness.

6. A recrystallized aluminum-lithium product having a duplex grain structure comprised of a fine grain structure and a coarse grain structure and having improved levels of strength and fracture toughness comprised of a lithium-containing aluminum base alloy consisting essentially of 1.5 to 2.5 wt. % Li, 1.6 to 2.8 wt. % Cu, 0.7 to 2.5 wt. % Mg, 0.05 to 1.0 wt. % of a grain structure control element selected from the class consisting of Zr, Cr, Hf, Ti, V, Sc, and Mn, 0.5 wt. % max. Fe, and 5 wt. % max. Si, with the balance consisting essentially of aluminum and incidental elements and impurities which has been thermomechanically processed by: heating the alloy to a high presoak temperature to homogenize the alloy; cooling the alloy to a first hot working temperature: reheating the alloy, after hot working, back to a high annealing temperature; cooling the alloy to a second hot working temperature to produce a first product; reheating the alloy, after a second hot working, to a lower annealing temperature: and then cold working the alloy.

7. The alloy product of claim 6 wherein the alloy, after cold working, has been solution heat treated, quenched, and aged, without an intervening anneal after said cold working, to provide a recrystallized sheet product having improved levels of strength and fracture toughness.

8. The alloy product of claim 7 wherein said duplex mode recrystallized alloy product is further characterized by a fine grain structure adjacent the surface of the alloy product and a coarse grain structure adjacent the center of the alloy product.

9. The alloy product of claim 8 wherein said grain structure control element comprises zirconium.

10. The alloy product of claim 9 wherein the amount of said zirconium grain structure control element comprises from 0.10 to 0.15 wt. %.

11. The alloy product of claim 9 wherein said aluminum-lithium alloy consists essentially of from 1.5 to 2.5 wt. % Li, 1.6 to 2.8 wt. % Cu, 0.7 to 2.5 wt. % Mg, and 0.10 to 0.15 wt. % Zr, with the balance consisting essentially of aluminum and impurities.

12. The alloy product of claim 9 wherein said aluminum-lithium alloy consists essentially of from 1.7 to 2.3 wt. % Li, 1.8 to 2.5 wt. % Cu, 1.1 to 1.9 wt. % Mg and 0.10 to 0.15 wt. % Zr, with the balance consisting essentially of aluminum and impurities.

13. The aluminum-lithium alloy of claim 9 wherein said alloy. comprises an alloy product which is initially heated to a presoak temperature of from about 482° to 566° C. (900° to 1050° F.) and held at this temperature for about 20 to 40 hours to homogenize the alloy.

14. The aluminum-lithium alloy of claim 13 wherein said alloy comprises an alloy product which is air cooled after said homogenization to a first hot working temperature of about 850° to 900° F. and then hot worked at this temperature.

15. The aluminum-lithium alloy of claim 14 wherein said alloy product has been hot worked by hot rolling to a thickness of from about 1 to 5 inches.

16. The aluminum-lithium alloy of claim 15 wherein said alloy comprises an alloy product which is reheated, after said hot working, back to a high annealing temperature of from about 900° to 1050° F.; held at this temperature for about 2 hours; then air cooled to a second hot working temperature of from about 850° to 900° F.; and then hot worked at this temperature.

17. The aluminum-lithium alloy of claim 16 wherein said alloy product has been hot worked a second time by hot rolling said alloy product to a thickness of from about 1.5 to 3 times the desired final gauge of the alloy product.

18. The aluminum-lithium alloy of claim 17 wherein said alloy comprises an alloy product which is reheated after said second hot working to an annealing temperature of about 750° to 860° F. and held at this temperature for about 10 to 14 hours to anneal said alloy product.

19. The aluminum-lithium alloy of claim 17 wherein said alloy comprises an alloy product which is reheated after said second hot working to an annealing temperature of about 780° to 820° F. and held at this temperature for about 10 to 14 hours to anneal said alloy product.

20. The aluminum-lithium alloy of claim 18 wherein said alloy comprises an alloy product which has been air cooled after annealing and then cold worked.

21. The aluminum-lithium alloy of claim 20 wherein said cold worked alloy, product comprises an alloy product cold rolled to final desired gauge.

22. The aluainum-lithium alloy of claim 20 wherein said alloy comprises an alloy product which, after said cold working, has been solution heat treated, quenched, and aged.

23. A process for producing a duplex mode recrystallized aluminum-lithium alloy product having improved levels of strength and fracture toughness characterized by a fine grain structure at the surface of the product and a coarse grain structure at the center of the product comprising the steps of:

(a) providing a aluminum-lithium alloy consisting essentially of 0.5 to 4.0 wt. % Li, 0 to 5.0 wt. % Cu, 0 to 5.0 wt. % Mg, 0.5 to 1.0 wt. % of a grain structure control element selected from the class consisting of Zr, Cr, Hf, Ti, V, Sc, and Mn, 0.5 wt. % max. Fe, and 5 wt. % max. Si, with the balance consisting essentially of aluminum and incidental elements and impurities:

(b) heating the alloy to a high presoak temperature to homogenize the alloy;

(c) cooling the alloy to a first hot working temperature;

(d) hot working the alloy;

(e) reheating the alloy, after hot working, back to a high annealing temperature;

(f) cooling the alloy to a second hot working temperature;

(g) hot working said alloy a second time to produce a first intermediate product;

(h) reheating the alloy, after said second hot working step, to a lower annealing temperature; and (i) then cold working the alloy.

24. The process of claim 23 including the further steps of solution heating treating, cold water quenching, and aging said alloy after said cold working step without any intervening annealing step to provide a duplex mode recrystallized sheet product having improved levels of strength and fracture toughness.

25. The process of claim 23 wherein said step of heating said alloy to a high presoak temperature to homogenize the alloy further comprises heating said alloy to a presoak temperature of from about 482° to 566° C. (900° to 1050° F.) and holding said alloy at this temperature for about 20 to 40 hours to homogenize the alloy.

26. The process of claim 25 wherein said steps of cooling the alloy to a first hot working temperature and then hot working the alloy further comprise air cooling said alloy after said homogenization to a first hot working temperature of about 880° to 900° F. and then hot working said alloy at this temperature.

27. The process of claim 26 wherein said hot working step further comprises hot rolling said alloy to a thickness of from about 1 to 5 inches.

28. The process of claim 26 wherein said step of reheating said alloy, after hot working, back to a high annealing temperature further comprises heating said alloy back to a high annealing temperature of from about 900° to 1050° F. and holding said alloy at this temperature for about 2 hours.

29. The process of claim 28 wherein said steps of cooling said alloy to a second hot working temperature and then hot working said alloy a second time to produce a first intermediate product further comprise air cooling said alloy to a second hot working temperature of from about 870° to 890° F. and then hot working said alloy at this temperature.

30. The process of claim 29 wherein said step of hot working said alloy a second time further comprises hot rolling said alloy to a thickness of from about 1.5 to 3 times the desired final gauge of the alloy product.

31. The process of claim 29 wherein said step of reheating the alloy, after said second hot working step, to a lower annealing temperature further comprises reheating said alloy product, after said second hot working step, to an annealing temperature of about 750° to 860° F. and holding said alloy product at this temperature for about 10 to 14 hours to anneal said alloy product.

32. The process of claim 31 wherein said step of cold working said alloy product further comprises air cooling said alloy product after said annealing step and then cold rolling said alloy product to final desired gauge.

33. The process of claim 32 including the further steps of solution heat treating said alloy product after said cold working step and without an intervening anneal step, quenching said solution heat treated alloy product, and then aging sai quenched alloy product.

34. The process of claim 33 wherein said solution heat treatment step further comprises heating said cold worked alloy product to a temperature of from 960° to 1020° F. for a period of from about 20 to 40 minutes.

35. The process of claim 34 wherein said quenching step further comprises quenching said alloy product at a rate of at least 100° F. per second from said solution heat treatment temperature to a temperature of about 200° F. or lower using a water quench.

36. The process of claim 35 wherein said aging step further comprises aging said alloy product in the range of 66° to 150° to 400° F. for a sufficient period of time to increase the yield strength to from about 50 to 85 ksi.

37. The process of claim 36 wherein said alloy product is aged for a period of from about 30 minutes up to about 24 hours.

38. A process for producing a duplex mode recrystallized aluminum-lithium alloy product having improved levels of strength and fracture toughness characterized by a fine grain structure at the surface of the product and a coarse grain structure at the center of the product comprising the steps of:

(a) providing a aluminum-lithium alloy consisting essentially of from 1.5 to 2.5 wt. % Li, 1.6 to 2.8 wt. % Cu, 0.7 to 2.5 wt. % Mg, and 0.03 to 0.19 wt. % Zr, with the balance consisting essentially of aluminum and impurities.

(b) heating the alloy to a high presoak temperature to homogenize the alloy;

(c) cooling the alloy to a first hot working temperature;

(d) hot working the alloy;

(e) reheating the alloy, after hot working, back to a high annealing temperature;

(f) cooling the alloy to a second hot working temperature;

(g) hot working said alloy a second time to produce a first intermediate product;

(h) reheating the alloy, after said second hot working step, to a lower annealing temperature; and (i) then cold working the alloy.

39. The alloy product of claim 38 wherein said aluminumlithium alloy consists essentially of from 1.7 to 2.3 wt. % Li, 1.8 to 2.5 wt. % Cu, 1.1 to 1.9 wt. % Mg, and 0.10 to 0.15 wt. % Zr, with the balance consisting essentially of aluminum and impurities.

40. The method in accordance with claim 38 wherein said product is naturally aged.

41. A process for producing a duplex mode recrystallized aluminum-lithium alloy product having improved levels of strength and fracture toughness characterized by a fine grain structure at the surface of the product and a coarse grain structure at the center of the product comprising the steps of:

(a) providing a aluminum-lithium alloy consisting essentially of 0.5 to 4.0 wt. % Li, 0 to 5.0 wt. % Cu, 0 to 5.0 wt. % Mg, 0.10 to 1.0 wt. % of a grain structure control element selected from the class consisting of Zr, Cr, Hf, Ti, V, Sc, and Mn, 0.5 wt. % max. Fe, and 5 wt. % max. Si, with the balance consisting essentially of aluminum and incidental elements and impurities;

(b) heating the alloy to a presoak temperature of from about 900° to 1050° F. and holding said alloy at this temperature for about 20 to 40 hours to homogenize the alloy;

(c) air cooling said alloy after said homogenization to a first hot working temperature of about 471° to 880° to 900° F.;

(d) hot rolling said alloy to a thickness of from about 1 to 5 inches:

(e) reheating said alloy, after hot working, back to a high annealing temperature of from about 900° to 1050° F. and holding said alloy at this temperature for about 2 hours;

(f) air cooling said alloy to a second hot working temperature of from about 870° to 890° F.;

(g) hot rolling said alloy to a thickness of from about 1.5 to 3 times the desired final gauge of the alloy product;

(h) reheating said alloy product, after said second hot working step, to an annealing temperature of about 780° to 820° F. and holding said alloy product at this temperature for about 10 to 14 hours to anneal said alloy product;

(i) air cooling said alloy product after said annealing step;

(j) cold rolling said alloy product to final desired gauge;

(k) solution heat treating said alloy product after said cold working step, and without an intervening anneal step, by heating said old worked alloy product to a temperature of from 96% to 1020° F. for a period of from about 20 to 40 minutes: and (l) quenching said alloy product at a rate of at least 100° F. per second from said solution heat treatment temperature to a temperature of about 200° F. or lower using a water quench.

42. The method in accordance with claim 41 including aging said alloy product in the range of 150° to 400° F. for a period of from about 30 minutes up to about 24 hours to increase the yield strength to from about 50 to 85 ksi.

43. The method in accordance with claim 41 including naturally aging and stretching said alloy product to produce a T3 temper.

* * * * *